United States Patent [19]

Tinnes

[11] 4,273,315

[45] Jun. 16, 1981

[54] SLIDE CLOSURE FOR THE TAPPING CHANNEL OF A MOLTEN METAL CONTAINER

[75] Inventor: Bernhard Tinnes, Zollikerberg, Switzerland

[73] Assignee: Metacon AG, Zurich, Switzerland

[21] Appl. No.: 145,875

[22] Filed: May 1, 1980

[30] Foreign Application Priority Data

May 7, 1979 [DE] Fed. Rep. of Germany ..... 2918344

[51] Int. Cl.[3] ..... C21C 5/48

[52] U.S. Cl. ..... 266/236; 266/271

[58] Field of Search ..... 266/236, 271

[56] References Cited

U.S. PATENT DOCUMENTS

| | | | |
|---|---|---|---|
| 1,889,434 | 11/1932 | Brosius | 266/236 |
| 2,643,004 | 6/1953 | Wingenroth | 266/236 |
| 4,026,443 | 5/1977 | Meier | 266/271 |
| 4,093,452 | 6/1978 | Spenceley | 75/58 |

*Primary Examiner*—P. D. Rosenberg

*Attorney, Agent, or Firm*—Cushman, Darby & Cushman

[57] ABSTRACT

A slide closure for the tapping channel of a molten metal container such as a furnace or vessel has a slide housing with a refractory bottom plate and a movable slide with a refractory slide plate. A lifting drive is detachably connected to the slide by way of a coupling while a flexible supporting member connects the lifting drive to the container. A detachable connecting member extends between the slide housing and a housing for the drive, and this member acts on the slide housing in a plane containing the axis of the lifting member and symmetrically with respect to that axis.

11 Claims, 3 Drawing Figures

50
62
64
54
58
48
82
98
86
80
104
84
44
III
92
36
14
28
60
52
56
46
100
III
88
42
40
94
90
38

14
28
90
92
36
86
88
84
82
48

SLIDE CLOSURE FOR THE TAPPING CHANNEL OF A MOLTEN METAL CONTAINER

DESCRIPTION

The invention relates to a slide closure for the tapping channel of a molten metal container.

Slide closures are known having a slide housing with a refractory bottom plate, a slide with a refractory slide plate and a lifting device comprising a lifting drive detachably connected to the slide, the housing for the drive being detachably connected to the slide housing. In such a closure it is known for the slide unit to be detachably fastened to a frame. Stay bolts fastened to the frame pass through the slide housing, which is pressed against the frame by wedges cooperating therewith. The frame, which in turn is mounted on the tapping connection of the container, such as a vessel or furnace, carries a lifting drive in the form of a cylinder and piston unit. The piston rod is coupled to the slide by means of a quick-action coupling. Consequently, when refractory parts of the slide closure which are subject to wear have to be replaced, the closure unit can be replaced as a unit by detachment from the frame and disconnection from the lifting drive by releasing the quick-action coupling.

Since in the known arrangement both the closure unit and the lifting drive are fastened on the frame, not only does this make it possible for the lifting drive to be left on the furnace while the closure unit is being changed, so that it is not necessary to detach the pipes for the pressure medium, but it is also possible to dispense with the utilisation of the furnace framework for taking the heavy reaction forces due to the operation of the slide.

However, a disadvantage of this arrangement is that reaction forces may displace the slide housing relative to the frame to the extent of the play of the fastening means, and that in addition the transmission of forces to the frame may lead to deformation of the latter. Since the frame carries the baseplate through the slide housing, such displacements and deformations may impair the seating conditions between the baseplate and the connecting bricks of the tapping channel and endanger the usual mortar seal. Furthermore, because of its size, the frame also constitutes an expensive additional component.

According to the present invention there is provided a slide closure for the tapping channel of a molten metal container, the closure including a slide housing having a refractory bottom plate and guiding a movable slide which has a refractory slide plate, a lifting drive detachably connected to the slide by way of a coupling, a housing for the lifting drive, a flexible supporting member connectable to the container framework for the lifting drive, and a detachable connecting member between the drive housing and the slide housing, which connecting member acts on the slide housing in a plane containing the axis of the lifting member and symmetrically with respect to the said axis.

With the invention, although the closure unit can be detached from the container independently of the lifting drive, the reaction forces are transmitted to the slide housing independently of the fastening means of the closure unit and, on operation of the slide, cannot either act on the container itself or affect the seating conditions of the closure unit on the tapping channel.

Because the lifting drive housing is connected to the container by way of the supporting member, when the closure unit is removed from the container the lifting drive is supported independently, so that the pipes for pressure medium and coolant which lead to it do not need to be disconnected. On the other hand, the flexible nature of the supporting member enables the container to be kept free from reaction forces when the lifting drive housing is coupled to the slide housing. Finally, the connecting member transmits the reaction forces directly into the slide housing, in such a manner that deformations and movements which could affect the seating conditions at the tapping channel do not occur.

In preferred embodiments of the invention the connecting member is guided for axial sliding on the housing of the lifting drive, so that connection to the slide housing is facilitated.

A similar effect is achieved in other preferred embodiments of the invention, in which a counterweight acts on the connecting member.

According to another preferred feature provision can be made for a chain or rope drive to couple the connecting member to the counterweight and to be guided on a cross member which connects the supporting member to the container framework.

In other embodiments there may be, for the supporting member, a plurality of springs and guide rods. The guide rods can be generally parallel to one another and pass with play through two plates, of which one is rigidly connected to the drive housing and the other is to be rigidly connected to the container framework, each rod carrying pairs of cup springs, one of which pairs is disposed with a bias between a rod head and one of the two plates.

In alternative embodiments in which the lifting drive is in the form of a cylinder and piston unit, the connecting member can have a sleeve which engages over the cylinder and which receives, in diametrically opposite guide slots, guide bars fastened to the cylinder. The connecting member is also then provided with diametrically disposed guide bars engaging in slots in the slide housing.

The cylinder preferably has a supporting arm for a coupling member pivotally attached to the piston rod.

The connecting member may, again, be fastened by pairs of socket pins to the cylinder and to the slide housing, while it is also possible to provide a lift indicator connected to the lifting means and mounted on the housing of the lifting drive.

In order that the invention may be more clearly understood, the following description is given by way of example only with reference to the accompanying drawings, in which.

Figure 1:
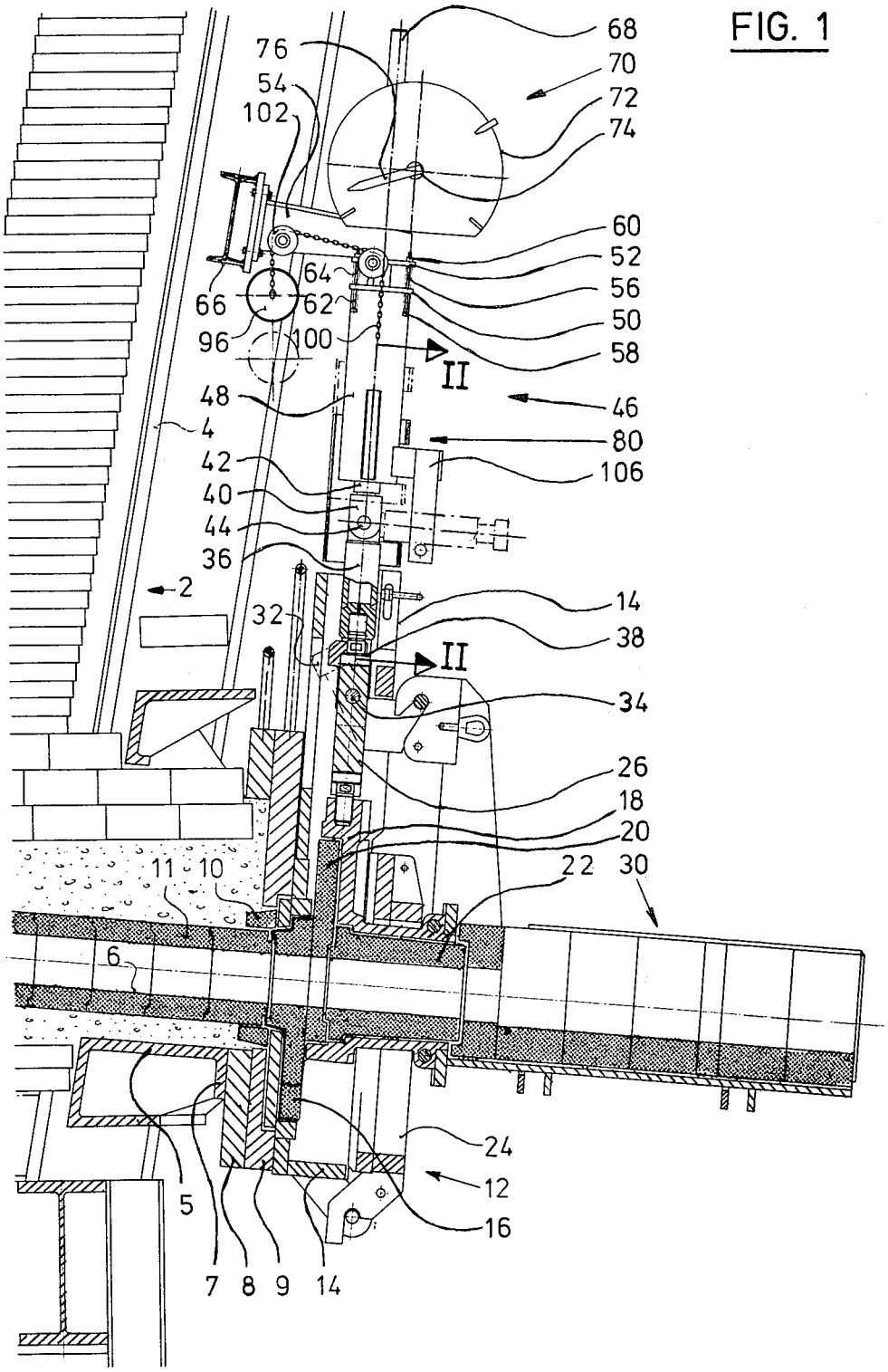
FIG. 1 is a vertical section through a slide closure according to the example of embodiment, attached to a furnace.

In the drawings, 2 designates generally a furnace which comprises a framework 4, a tapping connection 5, and a tapping channel 6 extending through the latter. An intermediate flange 8 is fastened to the tapping connection 5 by means of a flange 7 surrounding the end face of the tapping connection. The intermediate flange 8 in turn carries a baseplate 9 detachably fastened by means of stay bolts and wedges (not shown). While the annular intermediate flange permits access to the filler compound surrounding the tapping channel 6, the baseplate 9 receives in its roughly central opening a refractory ring 10, which surrounds an outermost channel brick 11 of the tapping channel 6. A closure unit (given the general reference 12) of a slide closure is mounted detachably in known manner (not illustrated) to the baseplate 9, for example by means of stay bolts and wedges. The closure unit comprises likewise in known manner a slide housing 14, which contains a refractory bottom plate 16 and also a slide 18, which is displaceable in the slide housing parallel to the bottom plate and in turn contains a refractory slide plate 20 cooperating with the bottom plate and also a refractory discharge sleeve 22. A housing cover 24 presses the slide plate 20 by means of the slide 18 against the bottom plate. The slide housing 14 contains, in line with the slide 18, a sliding guide member 26 which is connected to the slide 18 and which together with the slide 18 carries an outlet chute given the general reference 30.

Figure 2:
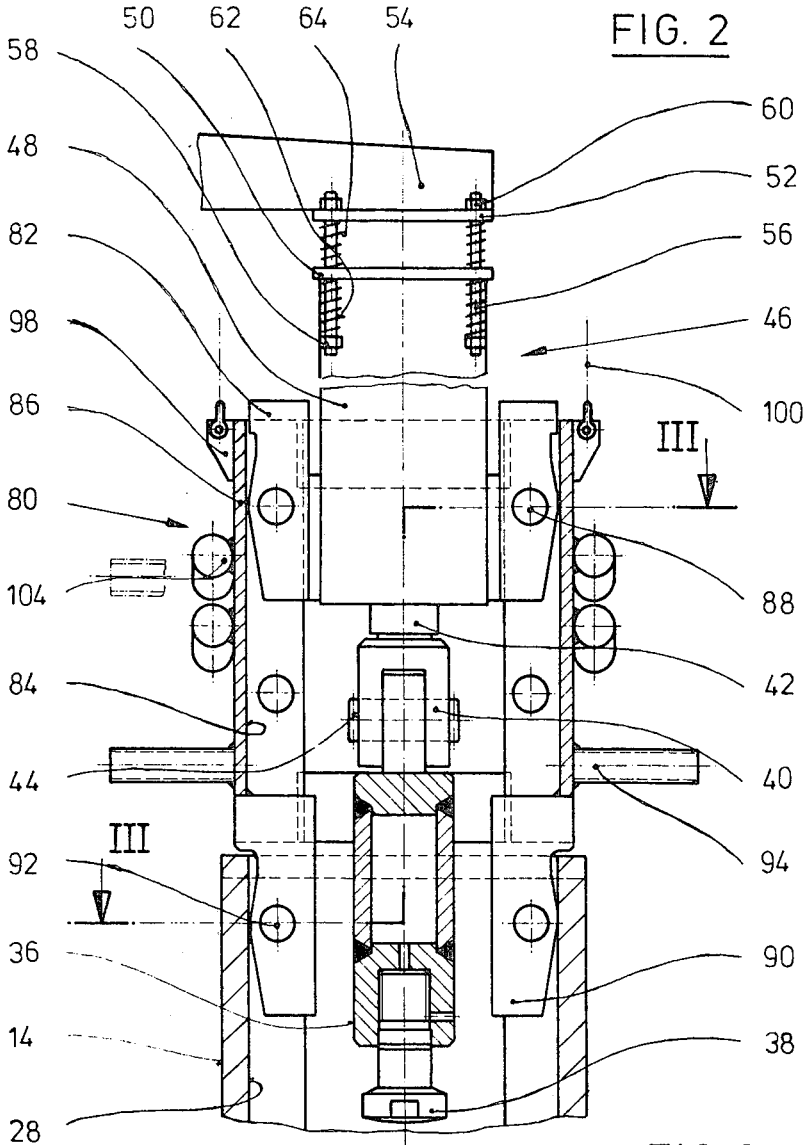
FIG. 2 is a section on the line II—II in FIG. 1.

The sliding guide member 26, which is displaceable in guide slots 28 (FIG. 2) in the slide housing 14, carries at its end remote from the slide 18 a claw member 32 which is swivellable about pins 34. The claw member 32 engages over a hammerhead 38 (FIG. 2), which is mounted on a coupling member 36. The coupling member 36 is fastened in a forked extension 40 of a piston rod 42 for swivelling about a pin 44. The piston rod 42 is part of a cylinder and piston unit 46 or equivalent structure forming a lifting or linear drive.

At the end remote from the slide housing 14 the cylinder 48 of the unit 46 has a plate 50, which faces a plate 52 fastened on a bracket 54. Four guide rods 56 pass, in positions parallel to one another, through the two plates 50 and 52. Each of the guide rods 56, which at one end have a head 58 and at the other end have a stop nut 60, carries between the head 58 and the plate 50 a first cup spring stack 62, and between the two plates 50 and 52 a second cup spring stack 64. The guide rods 56 and the spring stacks 62 and 64 form together a flexible supporting member for the cylinder and piston unit 46. This supporting member permits movements of the cylinder and piston unit in the axial direction and also, although only to a slight extent, deflection thereof in all directions relative to the plate 52. The significance of this movability will be explained in greater detail later on.

The plate 52 is rigidly connected by means of the bracket 54 to a cross member 66, which in turn is fastened to the furnace framework 4.

The cylinder 48, to which pipes (not shown) for a pressure medium and also pipes for a cooling medium are connected with a slight degree of flexibility, carries at its end provided with the plate 50 a coaxially disposed guide and protective tube 68, which passes with play through a central opening (not shown) in the plate 52 and carries a dial 72 of a lift indicator given the general reference 70. A rack (not shown), which is connected to the piston (not shown) of the cylinder and piston unit 46 and which is guided in the tube 68, is connected to a pointer 76 with the aid of a a pinion (likewise not shown) and of a shaft 74 on which the said pinion is mounted.

The shaft 74 and the pinion are disposed in a casing (not shown) mounted on the tube 68. The pointer 76 cooperates with the dial 72, which carries a scale representing the travel of the slide.

Figure 3:
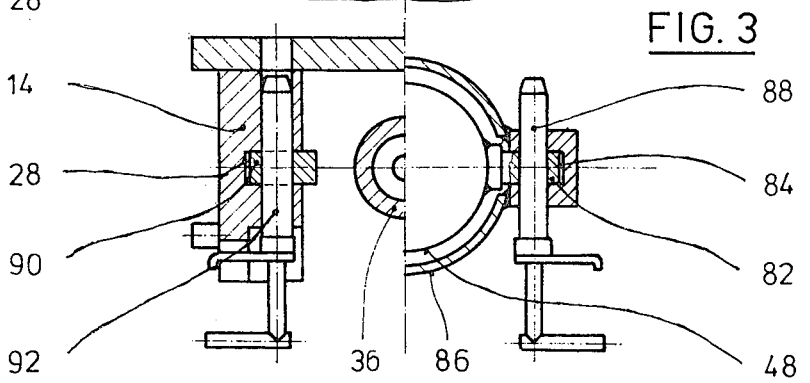
FIG. 3 is a section on the line III—III in FIG. 2.

In order to take the reaction forces which are produced on the operation of the cylinder and piston unit 46, the cylinder 48 is frictionally connected to to the slide housing 14 by means of a connector given the general reference 80. As can be seen more clearly from FIGS. 2 and 3, the cylinder 48 carries at its end facing the slide housing two guide bars 82 which are disposed diametrically opposite one another. These bars engage in correspondingly disposed slots 84 in a sleeve 86 which engages over the end of the cylinder 48. Two detachable socket pins 88, which pass through the sleeve 86 and guide bars 82, connect the cylinder 48 to the connector 80. On the other hand, at that end of the sleeve 86 which faces the slide housing 14 guide bars 90 are fastened, in line with the guide bars 82, and engage in the guide grooves 27 in the slide housing 14. Socket pins 92 held in the slide housing pass through the guide bars 90 and connect the connector 80 to the slide housing 14.

The connector 80, which is provided with handles 94, is connected to a load-relieving weight 96. Chains 100 are connected to lugs 98 on the sleeve 86 and pass over guide wheels 102 mounted on the bracket 54, then being connected to the weight 96.

Finally, sockets 104 for socket pins 88 and 92 respectively are provided on the sleeve 86, while a supporting arm 106, the purpose of which will be explained later on, is fastened to the cylinder 48.

In FIG. 1 all movable parts are shown in the position which corresponds to the complete opening of the slide closure, and in which the discharge sleeve 22 is in line with the tapping channel 6. In this position of the parts it is possible to remove the closure unit 12 from the furnace when the refractory parts 16, 20, 22 require replacement because of wear. After removal of the discharge chute 30 the closure unit 12 can be removed as a unit from the furnace 2 and baseplate 9 by bringing the claw member 32 into the position shown in broken lines in FIG. 1 by a swivelling movement, removing the socket pins 92 and 88 to detach the connector 80 from the slide housing 14 and cylinder 48 and then moving the said connector with the aid of the handles 94, and with the support of the load-relieving weight 96, into the position shown in broken lines in FIG. 1, whereupon the coupling member 36 is swivelled about the pin 44 into the position shown in broken lines and secured to the supporting arm 106 with the aid of one of the socket pins 88 or 92, and finally, after removal of the wedges (not shown) which act on the slide housing, the latter is pulled off the stay bolts mounted on the baseplate 9. A closure unit 12 with new refractory parts can thereupon be fastened to the furnace by the reverse sequence of the steps described, while the customary mortar seal between the baseplate 16 and the channel brick 11 and ring 10 can also be renewed, if necessary after replacement of the ring 10.

It is also possible to disconnect the cylinder and piston unit 46 from the closure unit 12 when the slide 18 is in the closed or not completely open position. In this case, after disconnection of the claw member 32 and raising the connector 80, it is merely necessary to bring the piston rod 42 into the top end position shown in FIG. 1 before swivelling out the coupling member 36.

When the connecting member 80 is in the detached and raised position, the cylinder and piston unit 46 is held by the flexible supporting member 56, 62, 64, while the connecting member 80 can be secured to the cylinder 48 by means not shown. When the connection is made between the cylinder 48 and the slide housing 14 by means of the coupling member, the flexible construction of the supporting member and of the pipe connections for pressure medium and coolant facilitates the insertion of the guide bars 90 into the guide slots 28 and the introduction of the socket pins 88 and 92. The flexible construction of the supporting member 56, 62, 64 obviously also permits relative movements between the bracket 54 and the cylinder 48 which result from different coefficients of expansion through thermal loading of the furnace framework on the one hand and of the closure unit, including the lifting drive, on the other hand.

It can be seen that because the guide bars 90 act on the slide housing 14 symmetrically in relation to the axis of the cylinder and piston unit 46, and in a plane containing this axis, and because the guide bars 82 also act on the cylinder 48 symmetrically to the said axis and in a corresponding plane, practically no deformation forces are applied to the slide housing 14 as the result of the transmission of the reaction forces to the said housing.

I claim:

1. A slide closure for the tapping channel of a molten metal container provided with a framework, such closure comprising a slide housing, a refractory bottom to said housing, a movable slide guided by said slide housing, a refractory slide plate to said movable slide, a lifting drive detachably connected to said slide, a coupling interconnecting said lifting drive and slide, a housing for said lifting drive, a flexible supporting member connectable to said container framework for supporting said lifting drive, and a detachable connecting member between said drive housing and said slide housing, said connecting member being arranged to act on said slide housing in a plane containing the axis of said lifting member and symmetrically with respect to the said axis.

2. A slide closure as claimed in claim 1, wherein the connecting member is guided for axial sliding movement on the drive housing.

3. A slide closure as claimed in claim 1 and further comprising a counterweight acting on said connecting member.

4. A slide closure as claimed in claim 3, including a flexible coupling of one of chain and rope coupling said connecting member to said counterweight and further comprising a bracket which connects said flexible supporting member to said container framework and guides said flexible coupling.

5. A slide closure as claimed in claim 1, wherein said flexible supporting member comprise a plurality of generally parallel springs and guide rods.

6. A slide closure as claimed in claim 5, including two plates, said guide rods passing with play through said two plates, one said plate being rigidly connected to said drive housing, the other said plate being for rigid connection to said container framework, pairs of cup spring stacks carried on each said guide rod, one said stack being disposed between said two plates and the other said stack being disposed with a bias, between a rod head and one of said two plates.

7. A slide closure as claimed in claim 1 and further comprising a lifting drive in the form of a cylinder and piston unit, a sleeve to said connecting member, said sleeve engaging over said cylinder diametrically opposed guide slots in said sleeve receiving guide bars fastened on said cylinder, further guide bars provided on said sleeve and disposed diametrically opposite one another, and slots in said slide housing in which said further guide bars extend.

8. A slide closure as claimed in claim 7, including a supporting arm for the cylinder, said supporting arm supporting a coupling member pivotally attached to said piston rod.

9. A slide closure as claimed in claim 7 including pairs of socket pins by which said connecting member is fastened to said cylinder and to said slide housing.

10. A slide closure as claimed in claim 1 and further comprising a lift indicator connected to said lifting member and mounted on said drive housing.

11. A slide closure as claimed in claim 1 wherein the slide housing, refractory bottom, movable slide and refractory slide plate comprise a slide unit attachable and detachable as a unit to and from the container framework.

* * * * *